United States Patent [19]

Weinmann

[11] 4,168,580

[45] Sep. 25, 1979

[54] DRYING INSTALLATION FOR TREATING WEBS OF MATERIAL

[75] Inventor: Alfred Weinmann, Graz, Austria

[73] Assignee: Maschinenfabrik Andritz Actiengesellschaft, Austria

[21] Appl. No.: 357,081

[22] Filed: May 4, 1973

[30] Foreign Application Priority Data

Jun. 2, 1972 [AT] Austria ..... 4744/72

[51] Int. Cl.[2] ..... F26B 13/06

[52] U.S. Cl. ..... 34/122; 34/155; 34/156; 432/59

[58] Field of Search ..... 34/114, 115, 122, 119, 34/124, 155, 156, 160; 432/8, 59

[56] References Cited

U.S. PATENT DOCUMENTS

| | | | |
|---|---|---|---|
| 2,218,282 | 10/1940 | Downs | 34/122 |
| 2,268,988 | 1/1942 | Hess et al. | 34/122 |
| 2,682,116 | 6/1954 | Dungler | 34/156 |
| 3,052,991 | 9/1962 | Goldner | 34/114 |
| 3,134,653 | 5/1964 | Justus et al. | 34/114 |
| 3,208,158 | 9/1965 | Smith | 34/114 |
| 3,230,636 | 1/1966 | Daane | 34/122 |
| 3,363,665 | 1/1968 | Daane et al. | 34/114 |
| 3,377,056 | 4/1968 | Boye | 34/160 |
| 3,541,697 | 11/1970 | Villalobos | 34/115 |
| 3,771,235 | 11/1973 | Minoda et al. | 34/156 |
| 3,771,239 | 11/1973 | Minoda et al. | 34/156 |

FOREIGN PATENT DOCUMENTS

| | | | |
|---|---|---|---|
| 668741 | 3/1952 | United Kingdom . | |
| 773908 | 5/1957 | United Kingdom | 34/122 |

*Primary Examiner*—Henry C. Yuen
*Assistant Examiner*—Larry I. Schwartz
*Attorney, Agent, or Firm*—James E. Bryan

[57] ABSTRACT

This invention relates to an improvement in a drying installation for treating a web of material including a drying hood having flow channels therein and heat sources and blowers for the circulation of a drying medium which is passed through apertures to said web and drawn off again through exhaust channels, the improvement comprising a plurality of profiled tube means mounted adjacent said web, the distances between said tube means constituting diffuser-like gaps serving as exhaust channels, and a plurality of apertures in said tube means directed toward said web, said apertures being in a triangular configuration and distributed over said tube means at a constant distance.

11 Claims, 5 Drawing Figures

DRYING INSTALLATION FOR TREATING WEBS OF MATERIAL

The present invention relates to a drying installation for treating webs of material, particularly webs of paper, cardboard or textiles, which is composed of a hood-like sheathing with flow channels disposed therein as well as heat sources and blowers for the circulation of a drying medium, for example hot air, that is passed or conveyed through openings to the web of material and drawn off again through different openings.

A drying installation serves for eliminating, or disposing of, the moisture contained in the web of material. It is the primary goal in this connection to obtain a high drying rate and drying speed with a low expenditure of energy.

It is known in the art for conveying and guiding web-like or sheet-like materials, such as webs of paper, to eliminate the moisture with the aid of a drying medium. While the web of material is constantly moved on a conveying mechanism, the drying medium is blown onto the web of material via discharge channels and drawn off again. Used for this purpose are so-called pressure chambers whose apertures are directed toward the web of material. The drying medium enriched with moisture is drawn off again through separate outlet apertures.

In order that a uniform action of the drying medium upon the web of material be achieved, several openings which are distributed over the width of the web of material are disposed in the discharge channels, from which the drying medium flows onto the web of material. It has been attempted to further enhance the drying effect by providing these openings in a specific manner, namely in the shape of triangles, pointing in a specific direction.

It is disadvantageous in this prior art arrangement that, while a good drying effect is attained on the portions of the web of material which are positioned directly above the openings, the material web does show a residual moisture in the neighboring border zones. Actually, drying zones are developed along the web of material which become visible as drying streaks. A uniform drying effect over the entire web of material cannot be obtained with this prior art arrangement.

Also known in the art is a type of drying installation in which a web of material is moved at a certain speed on a large cylindrical drum. Disposed for this purpose at the upper side or underside are reversing rollers which increase the looping angle or angle of grip of the web of material on the drum so that a greater drying surface is obtained. Disposed within this drum are air conduits into which the drying medium flows and reaches the web of material at the surface of the drum via a plurality of bores. While flowing through the web of material, moisture is absorbed by the drying medium and collected in a housing which surrounds the drum. The drying medium mixed with moisture passes by way of a central pipe line to a blower whose function it is to draw off the drying medium, condense it, feed it into an air heater and from there deliver it, in the heated condition thereof, back to the drum, whereby part of the drying medium is replaced by fresh air. In this particular arrangement, it is particularly disadvantageous that the web of material must be more of a porous material so that the weight rate of flow of the air can be maintained to some extent. With a denser material, such as cardboard or paper, this installation does not function properly. An enormous blower output must be provided for in order that the air circulation can be carried out at all.

It has further been proposed in the art to provide for a drying installation which likewise comprises a cylinder-shaped drum of the type referred to hereinabove. Mounted at a certain distance above the web of material is a plate having bores through which the drying medium is blown onto the web of material. At certain distances therefrom, other openings are disposed through which the drying medium enriched with moisture is carried off by a blower, in order to there render the cooled drying medium re-usable, equally via a heat source, by means of the application of heat and removal of moisture. This circulating process with the drawing off of moisture from the surface of the material against which the flow is directed has the advantage that all types of material webs can be dried by virtue of the fact that the outlet openings are directed at different angles opposite to the traveling direction of the web of material in order to produce a uniform distribution of the drying rate. At the same time, it has the disadvantage that high blower outputs are required inasmuch as the drying medium must travel to the material web surface over a longer path and because, as a result thereof, the kinetic energy cannot be fully utilized. Furthermore, this type of drying installation has a large structural volume.

The present invention provides a drying installation for treating webs of material, and is composed of a hood-like sheathing with flow channels disposed therein, and also contains heat sources and blowers for the circulation of the drying medium directed or conveyed through openings to the web of material and drawn off again through other openings. The configuration and design of the channels should be made in a manner such that flow-technically low losses result. Furthermore, small blower outputs should be necessary only, and in this connection also a compact construction should be maintained.

In accordance with the present invention, profiled tubes are uniformly disposed over an even or flat material web and/or grouped around a curved material web, the distances thereof with respect to each other forming diffuser-like apertures or gaps and serving as outlet or draw-off channels. The openings being directed toward the web of material are provided in a triangular arrangement and are distributed over all of the profiled tubes at a constant distance. This design assures that, by reason of the provision of the diffuser-like gaps, a part of the dynamic pressure is regained or recovered, and due to this fact the loss rate or ratio in the entire installation decreases to a certain extent. Therefore it is possible to operate with lower blower outputs because the openings toward the web of material are optimally arranged over the entire surface. This results in a uniform drying process with a good use of the blower output.

The present invention will now be described in further detail hereinafter on the basis of one embodiment thereof and with reference to the accompanying drawings, wherein FIG. 1 is a cross-sectional view through a drying installation as proposed by the present invention;

Figure 1:
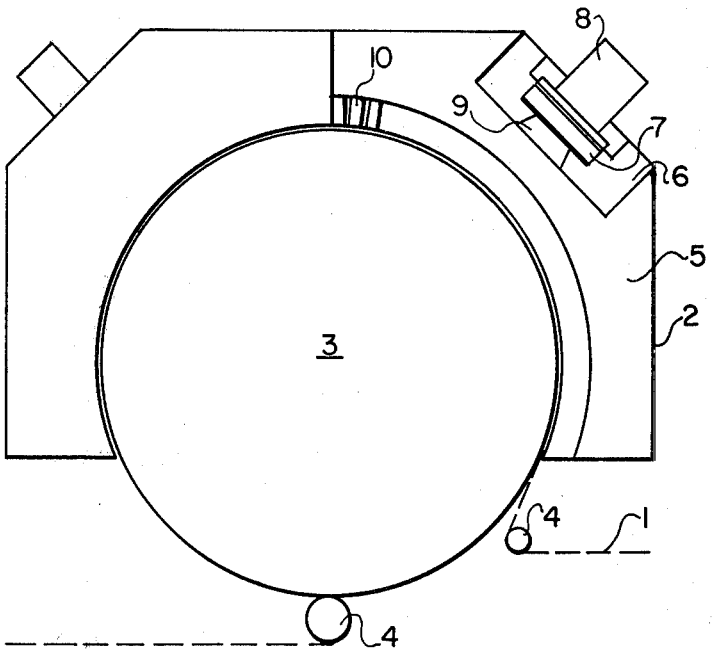

FIG. 1 is a cross-sectional view of a drying installation as proposed by the present invention. A roller 3 serves for receiving the web of material 1 and comprises at the underside thereof a reversing roller 4 and a second one approximately laterally with respect thereto. This arrangement for the reversal of the web of material has been found to be advantageous for drying webs of paper. In the drawing, the web of material 1 and the guidance thereof has been indicated in dashed lines. The drive and direction of movement of the web of material 1 are not essential for the drying process as such and therefore are not described herein.

Placed over the roller 3 and the web of material 1 is a housing-like hood 2 at a certain distance therefrom within which the flow channels for the circulation of the drying medium are accommodated. Positioned within the hood 2 is, first of all, the suction chamber 5 and, in an arrangement inclined about 45°, the transverse channel 6. The latter extends along the surface line of the roller 3 and comprises at the inside the blower 7 and the drive motor 8 thereof. For purposes of obtaining a flow-technically favorable transition to the blower 7, a suction connection 9 is disposed at the underside of the transverse channel 6, i.e. in connection with the suction chamber 5. Disposed at a certain distance 20, for example a distance of 10 to 25 mm, preferably 15 mm, with respect to the web of material and along the surface line of the roller 3 are a plurality of profiled tubes 10. These profiled tubes 10 have a rectangular cross-section, and they do not lie closely against each other but are mounted with certain distances and provided with gaps 19.

Figure 2:
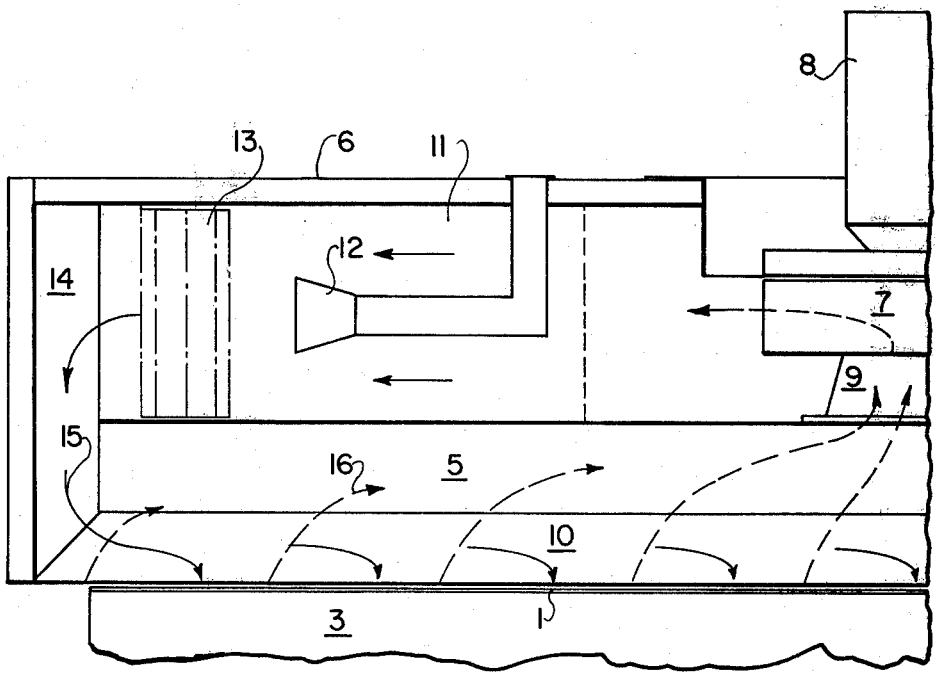
FIG. 2 is a cross-sectional view through a transverse channel.

FIG. 2 is a cross-sectional view taken along the transverse channel 6. At the underside, the roller 3 is disposed on which the web of material 1 is placed. At a certain distance there is provided—as has been set forth hereinabove—a plurality of profiled tubes 10 which are positioned transversely to the material web 1 and form at the two ends thereof an inclined open end. Connected to these ends are on both sides the lateral channels 14. The lateral channels 14 are vertically disposed and extend so high that sufficient space is available above the profiled tubes 10 for the provision of the suction chamber 5 and the transverse channel 6. Provided on the upper side of the hood 2, aside from the blower 7 with the respectively coordinated drive motor 8 and suction connection 9 thereof, is on both sides a combustion chamber 11. Contained in the combustion chamber 11 is a burner 12. Indicated additionally in the drawing in dashed lines is a heat exchanger 13 which fulfills the same function as the burner 12. The provision of the heat sources in the combustion chamber 11 is known per se and is not explained in detail herein. It is essential that a closed cycle is produced in that the drying medium is initially fed by the blower 7 into the combustion chamber 11, heated therein to the desired drying temperature, and finally conveyed via the lateral channels 14 to the profiled tubes 10. Outlet openings 17 are disposed at the underside of the profiled tubes 10, i.e. viewed in the direction of the web of material 1. The drying medium and the flow direction thereof, has been indicated by arrows 15 in the drawing. The drying medium enriched with moisture is indicated by dashed arrows 16. The flow of the drying medium thus takes place from the blower 7 to the combustion chamber 11 and, by way of the lateral channels 14, arrives at the profiled tubes 10, the web of material 1 thus being reached. After having been enriched with moisture, the drying medium passes through the gaps 19 into the suction chamber 5 and finally into the suction connection 9 of the blower 7. The circulation process is thus completed. Part of the drying medium is drawn off during the circulation and replaced by fresh air. The exhaust lines and supply lines are connected to the suction chamber 5. Positioned laterally of the hood 2 is a supply line as well as, on the upper side, an exhaust line. It is further possible to provide a burner similar to the burner 12 inside the suction chamber 5, which burner heats the drying medium. These lines and the burner have not been shown in the drawing for the sake of simplicity of illustration.

Figure 3:
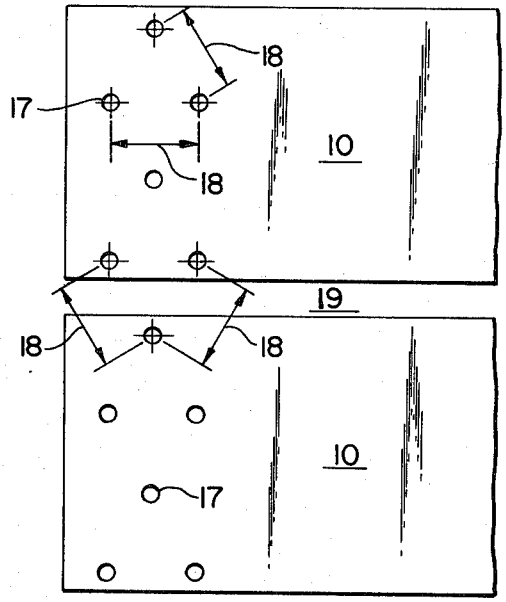
FIG. 3 illustrates outlet openings in profiled tubes.

FIG. 3 is a view from below of the openings 17 for the outlet of the drying medium to the web of material 1. In this connection it is significant that the profiled tubes 10 are mounted at a certain distance from each other and are uniformly distributed along the material web 1, specifically in such a manner that a gap 19 will always be produced which widens upwardly, i.e. toward the side facing away from the web of material 1, in a diffuser-like manner. The width of the gap amounts to approximately 1/10 of the width of the profiled tubes 10. The openings 17 are so positioned in the profiled tubes 10 that they are initially offset in succession, but have at all times the same distance 18 relative to each other. It is essential that the distance 18 be maintained also beyond the gap 19. This inventive arrangement of the openings 17 assures a uniform distribution of the drying medium over the web of material 1.

Figure 4:
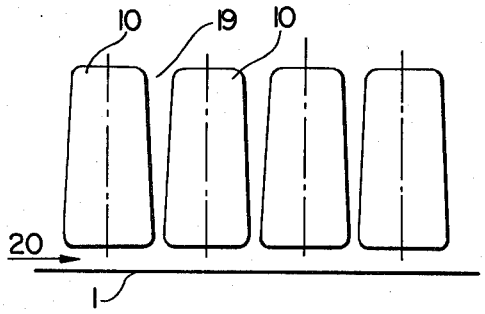
FIG. 4 is a cross-sectional view through the profiled tubes in an arrangement thereof on an even or flat material web.
Figure 5:
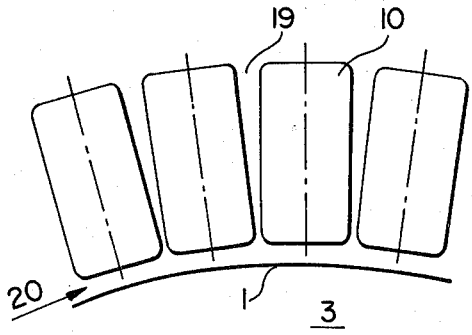
FIG. 5 is a cross-sectional view through the profiled tubes in an arrangement thereof on a curved material web.

FIGS. 4 and 5 show a cross-section of several profiled tubes 10 wherein particularly the gap 19 is of importance. It is produced due to the greater lateral surface of the arrayed profiled tubes 10 and so provided that at the inlet point of the drying medium the distance is smaller whereas on the side toward the suction connection 9 the gap widens. This arrangement results in a diffuser which is responsible for assuring that part of the dynamic pressure is recovered. Furthermore, the openings 17 are provided as round bores and have a diameter of from 3 to 6 mm. Tests have shown that the choice of such a diameter produces the best drying rate or ratio. It is essential that the outlet surface, i.e. the surface of all the outlet openings, amounts to approximately 1 to 3% of the total surface and that the suction surface, i.e. the surface of all the gaps, amounts to 10 to 20% of the total surface.

It is further important that a regulating device be present which maintains the cooling border temperature of the web of material 1 between 60° C. and 90° C.

As a matter of principle, a closed cycle exists in this drying installation. The drying medium enriched with water is drawn off from the web of material 1 and fed through the blower 7 into the combustion chamber 11 in which it is heated and thereupon conveyed by way of the lateral channels 14 again to the profiled tubes 10 and the openings 17 to the web of material 1. Since the degree of saturation must not exceed a certain maximum, a part of the drying medium is continuously replaced in the circulation by fresh air. Thus, there is positioned at the underside of the hood 2 toward the suction chamber 5 a connection which feeds fresh supply air into the suction chamber 5. This in turn requires that another connection for the exhaust be positioned at the upperside of the hood 2, and the air exchange takes place by means of additional blowers.

It is also important that the drying medium to be drawn off is subjected to a control which removes not only the entire evaporated amount of water, but also part of the exhaust gases which are formed as a result of the possible combustion during direct heating with burners arranged in the circulation. In addition thereto, the control or regulation of the temperature of the drying gases, the outlet velocity and the supply air and exhaust air quantities may be carried out either manually or automatically in dependence upon the drying content of the web of material on a selected point, for instance at the roller apparatus. The control or regulation may also be effected separately for the temperature, while the other values or entities, such as the outlet velocity, supply air or exhaust air quantities, and drying content, are maintained constant, or by a combination of the individual values or entities indicated.

With the aid of the inventive design and arrangement of the drying installation described herein it is possible to bring webs of material of any kind, such as paper, cardboard, or textile webs, to a rapid and perfect drying. This is attained by the suitable construction of the openings for the outlet of the drying medium onto the web of material and with specific suction channels serving as diffuser means. The blower output or capacity has lower requirements since favorable flow paths, such as transverse and lateral channels, and profiled tubes having a large cross-section, allow for an optimal design of the course of flow. In addition thereto, part of the dynamic pressure is recovered by means of the diffuser-like gaps.

It will be obvious to those skilled in the art that many modifications may be made within the scope of the present invention without departing from the spirit thereof, and the invention includes all such modifications.

What is claimed is:

1. In a drying installation for treating a web of material including a drying hood having flow channels therein and heat sources and blowers for the circulation of a drying medium which is passed through apertures to said web and drawn off again through exhaust channels, the improvement which comprises a plurality of profiled tube means mounted adjacent said web, the distances between said tube means constituting diffuser-like gaps serving as exhaust channels, and a plurality of apertures in said tube means directed toward said web, said apertures being in a triangular configuration and distributed over said tube means at a constant distance from each other.

2. A drying installation according to claim 1 in which the profiled tube means have a rectangular cross-section and constitute with the long lateral surfaces thereof the diffuser-like gaps of the exhaust channels.

3. A drying installation according to claim 1 in which the gap-forming distance between the profiled tube means amounts to approximately 1/10 of the profiled tube means width.

4. A drying installation according to claim 1 in which the apertures for blowing out the drying medium are round bores having a diameter in the range of 3 to 6 mm.

5. A drying installation according to claim 1 in which the distance of the profiled tube means from the web of material is 10 to 25 mm.

6. A drying installation according to claim 1 in which the blowout surface, i.e. the surface of all the outlet apertures, amounts to about 1 to 3% of the total surface.

7. A drying installation according to claim 1 in which the drawoff surface, i.e. the surface of all the gaps, amounts to 10 to 20% of the total surface.

8. A drying installation according to claim 1 including, on both sides of said profiled tube means extending transversely over said web of material, lateral channels for the supply of the drying medium, said latter channels being in operative connection with a transverse channel positioned thereover.

9. A drying installation according to claim 8 including a suction chamber mounted over said profiled tube means which chamber is in operative connection by way of said diffuser-like gaps with a blower in said transverse channel.

10. A drying installation according to claim 9 including, in said transverse channel, a heat source which heats the drying medium and is utilized for acting upon the apertures in said profiled tube means.

11. A drying installation according to claim 1 including means for subjecting the drying medium to be drawn off to a control which discharges both the entire evaporated water quantity in the drying medium, and also the water quantity and a part of the exhaust gases which are produced as a result of combustion during direct heating with burners positioned in the circulation.

* * * * *

UNITED STATES PATENT OFFICE

CERTIFICATE OF CORRECTION

Patent No. 4,168,580 Dated September 25, 1979

Inventor(s) Alfred Weinmann

It is certified that error appears in the above-identified patent and that said Letters Patent are hereby corrected as shown below:

Column 6, line 1, after "gaps", the following has been omitted: - - - converging adjacent said web and - - -; line 5, after "means" the following has been omitted: - - - and said gaps - - -.

Signed and Sealed this

*Twelfth* Day of *February 1980*

[SEAL]

*Attest:*

SIDNEY A. DIAMOND

*Attesting Officer*

*Commissioner of Patents and Trademarks*